US005707182A

United States Patent [19]

Leffer

[11] Patent Number: 5,707,182

[45] Date of Patent: Jan. 13, 1998

[54] PROCESS AND A DEVICE FOR EXACTLY HOLDING THE VERTICAL EXCAVATING DIRECTION OF A DIAPHRAGM WALL

[75] Inventor: Michael Leffer, Blieskastel, Germany

[73] Assignee: Stahlund Apparatebau Hans Leffer GmbH, Saarbrücken, Germany

[21] Appl. No.: 525,735

[22] PCT Filed: Mar. 7, 1994

[86] PCT No.: PCT/EP94/00671

§ 371 Date: Nov. 8, 1995

§ 102(e) Date: Nov. 8, 1995

[87] PCT Pub. No.: WO94/21864

PCT Pub. Date: Sep. 29, 1994

[30] Foreign Application Priority Data

Mar. 23, 1993 [DE] Germany ..... 43 09 233.0

[51] Int. Cl.[6] ..... E02D 5/18

[52] U.S. Cl. ..... 405/267; 405/232; 405/266; 37/348

[58] Field of Search ..... 405/237, 267, 405/232, 266, 240–243; 37/348

[56] References Cited

U.S. PATENT DOCUMENTS

| | | | |
|---|---|---|---|
| 1,369,235 | 2/1921 | Funk | 37/348 X |
| 3,283,230 | 11/1966 | Davies et al. | 37/348 X |
| 3,659,364 | 5/1972 | Wilson | 37/348 |
| 3,726,349 | 4/1973 | Heusler et al. | 37/348 X |
| 4,173,836 | 11/1979 | Paurat | 37/348 |
| 4,393,606 | 7/1983 | Warnecke | 37/348 X |
| 4,396,076 | 8/1983 | Inoue | 405/237 X |
| 4,491,927 | 1/1985 | Bachmann et al. | 37/348 X |
| 5,311,683 | 5/1994 | Camilleri | 405/267 X |

OTHER PUBLICATIONS

Bartholmai, Special Print 66 of Salzgitter Maschinen AG, "Attachments for Excavators", pp. 1–7.

*Primary Examiner*—Dennis L. Taylor
*Attorney, Agent, or Firm*—Wenderoth, Lind & Ponack

[57] ABSTRACT

A process for exactly holding the vertical excavation direction of a diaphragm wall using a hydraulic diaphragm wall grab cooperating with an excavator and having an outer guide body and an inner body for receiving the grab appliance is improved and rendered considerably more efficient by the fact that the vertical position of the inner body and/or the guide body is continuously controlled by means of an inclination detector whose-signals are transferred to a controller which, in case the bodies of the grab deviate from the predetermined vertical position, compensates said deviation by swivelling the inner body relative to the guide body in opposite direction to the deviation.

9 Claims, 3 Drawing Sheets

PROCESS AND A DEVICE FOR EXACTLY HOLDING THE VERTICAL EXCAVATING DIRECTION OF A DIAPHRAGM WALL

The present invention relates to a process and a device for exactly holding the vertical excavation direction of a diaphragm wall using a hydraulic diaphragm wall grab cooperating with an excavator and having an outer guide body and an inner body receiving the grab appliance.

Diaphragm walls and sealing walls have become an important component in foundation engineering. Normally, a diaphragm wall is constructed in single segments. In principle their depth is not definite, however, in case of greater depths there is the risk that diaphragm wall elements "run off" which, due to the deviation from the desired vertical position, results in gaps between the segments in the lower region of the wall, impairing the stability of the wall to be built. The construction of diaphragm walls having a depth of more than 40 m requires special experience and measures during excavation, for example, extensive measurements at the open slots. These are excavated without lining and, in case of inhomogeneous soil, tend to deviate from the predetermined vertical direction for this reason.

Usual widths of diaphragm walls amount to 600–800 mm, however, widths of 400–1,500 mm can also be found in construction work, depending on the depth and purpose of the diaphragm wall, In case a diaphragm wall segment deviates from the predetermined vertical direction it is necessary to cut the walls again using. profile chisels, in order to obtain a perfect vertical position of the wall. This process is time-consuming and increases construction expenses; for this reason the site supervision strives to hold the diaphragm wall excavation in the predetermined direction as exactly as possible.

It is known from the prior art to provide diaphragm wall grabs with so-called control plates mounted at the base frame. Such an arrangement is described, e.g., in the Special Print 66 of the Salzgitter gitter Maschinen AG, in the article "Anbaugeräte für Bagger" ["Attachments for Excavators"], Special appliances for drilling and building activities, by Dr.-Ing. Hans Bartholmai, illustrated on page 6, picture 15.

This equipment is suited to stabilize the vertical position during excavation of a diaphragm wall, however, it is unsuited to compensate an already existing deviation from the predetermined working direction.

It is the object of the present invention to provide a process and a device for exactly holding the vertical excavating direction of a diaphragm wall by means of a diaphragm wall grab, allowing primarily to immediately recognize any deviation from the predetermined excavating direction and to indicate same to the control panel of the diaphragm wall grab operator and secondarily to compensate said deviation by a modification of the direction of the grab.

In a process according to the introductory part of claim 1 this problem is solved according to the present invention by the fact that the vertical position of the inner body and/or guide body is continuously controlled by means of an inclination detector whose signals are transferred to a control unit and that, in case the bodies deviate from the predetermined vertical direction, this deviation is compensated by swivelling the inner body inversely to the deviation, relative to the guide body.

With this process the vertical excavating direction of a diaphragm wall can for the first time be held automatically exact by using a hydraulic diaphragm wall grab. This allows an efficient advance during the excavation of a diaphragm wall by avoiding both the expensive and time-consuming intermittent measuring of the excavated diaphragm wall part and subsequent work; additionally continuously advancing excavation can be carried out at a considerable cost reduction.

According to an embodiment of the present invention it is provided that any possible angular deviation from the vertical position is combined with a depth measuring device related to the diaphragm wall grab, a coordination of deviation and diaphragm wall depth is calculated and that this is indicated to the control panel of the diaphragm wall grab operator.

A device for exactly holding the vertical excavating direction of a diaphragm wall using a hydraulic diaphragm wall grab cooperating with an excavator and a guide body related to said grab, wherein said body is dimensioned according to the width of the grab shovels and is provided at its top with a mounting for suspension to a carrying rope arrangement or to a telescopic rod assembly is characterized according to the present invention by the following features:

- that the guide body forms an outer frame in which an inner body with hinged grab shovels and a hydraulic operating device is arranged;
- that the inner body within the guide body is pivoted in crosswise direction to the vertical course of the supporting wall by means of horizontal journals which are located in the direction of the diaphragm wall;
- that hydraulic swing mechanisms are provided between the guide body and the inner body;
- that a detector to control the vertical position is located at the inner body and/or guide body, and the excavator is provided with a control unit governed by the detector to operate the swivelling mechanisms.

In contrast to the known grab appliance guidance by means of rigid control plates, the inclination-controllable construction of the diaphragm wall grab according to the present invention can provide an extremely exact, sensitive and automatic vertical control of the grab appliance.

According to another embodiment it is provided that a depth measuring device is allocated to the diaphragm wall grab and that means are provided by which the indication of both the position detector and the depth measuring device can be mapped on each other.

By means of this device the excavator driver operating the diaphragm wall grab can always recognize whether the diaphragm wall in the excavation is within the predetermined position allowances at the respective depth and whether and which adjustments have be carried out.

For this purpose, it is provided according to another embodiment that means for an overriding manual regulative operation from the excavator control stand are allocated to the swing mechanism and to the control unit governing said swing mechanism; these means allow a correction of the grab direction according to the indication of the detector.

Furthermore, it is provided that a hydraulic piston/cylinder-unit is hinged to the left and to the right side of the guide body frame as means for mutually swivelling the guide body and the inner body; said unit interacts with an articulated lever arrangement which is also pivoted at the frame and has a cam which can be set in reciprocating swivelling movements and engages into a U-shaped guidance of the internal body and swivels same in accordance with the position of the cam relative to the guide body from the orthogonal position into a different swivelling position corresponding to an adjustment angle.

Preferred embodiments of the present invention are illustrated in schematic drawings illustrating additional advantageous details of the present invention:

Figure 1:
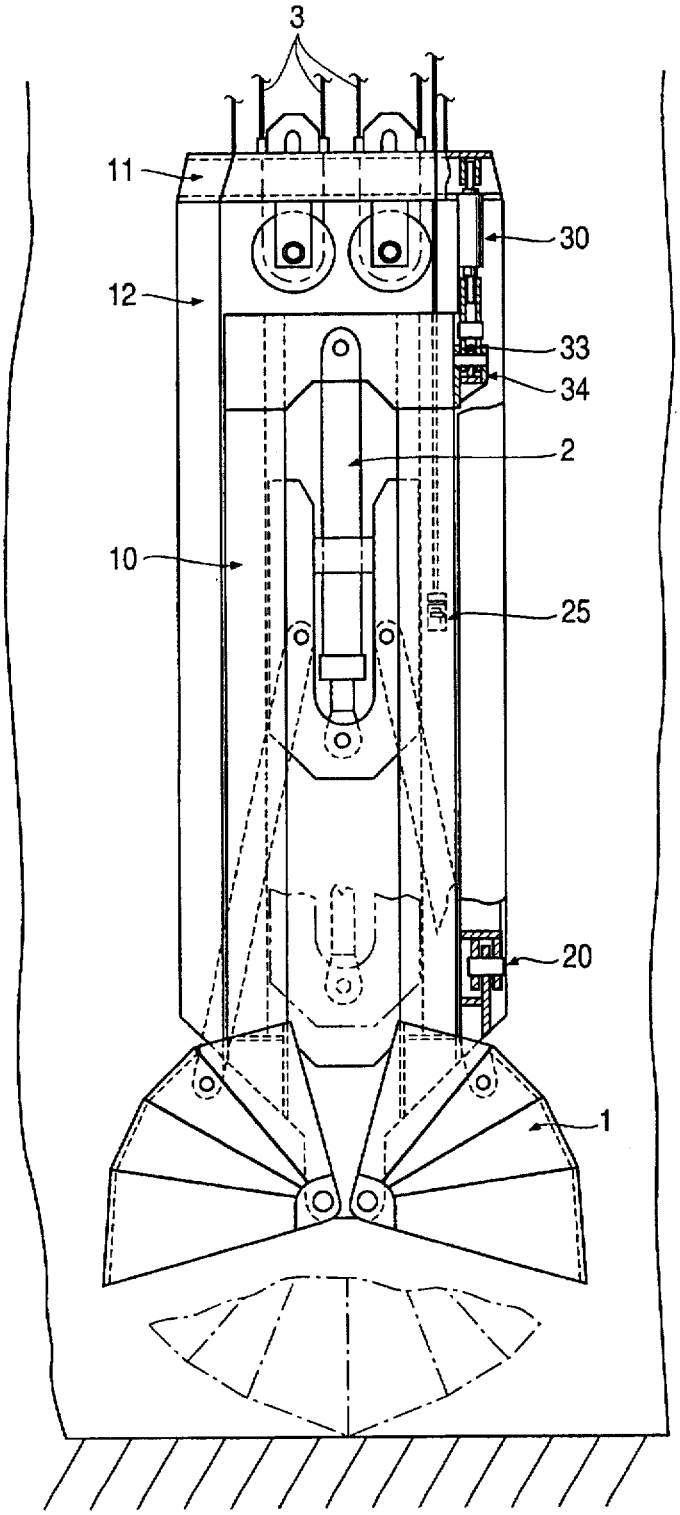
FIG. 1 illustrates the projection of a diaphragm wall grab in transverse direction to the diaphragm wall.

The diaphragm wall grab shown in FIG. 1 has a guide body 11 formed by an outer frame 12. An inner body 10 with hinged grab shovels 1 and hydraulic operating device 2 is located therein. The inner body 10 is hinged within the guide body 11 in transverse direction to the vertical course of the diaphragm wall 40 by means of horizontal journals 20 located in the direction of the diaphragm wall 40. Hydraulic swivelling means 30 are provided between the guide body 11 and the inner body 10. Furthermore, detectors 25 to control the vertical position of said bodies are arranged at the inner body 10 and/or the guide body 11. Via a signal line the detector(s) 25 is/are permanently connected to a control device which is governed by the detector(s) and actuates the swing means 30.

A depth measuring unit (not shown) may be allocated to the diaphragm wall grab, with means provided by which the indication of the position detector 25 and the indication of the depth measuring device can be mapped on each other. Additionally, further means for an overriding manual regulative operation from the excavator control stand (not shown) can advantageously be allocated to the mechanisms 30 for swivelling the internal body 10 or to the governing control device; with these means the position of the inner body 10 can be adjusted relative to the guide body 11 in accordance with the position indication of the position detector 25.

Figure 2:
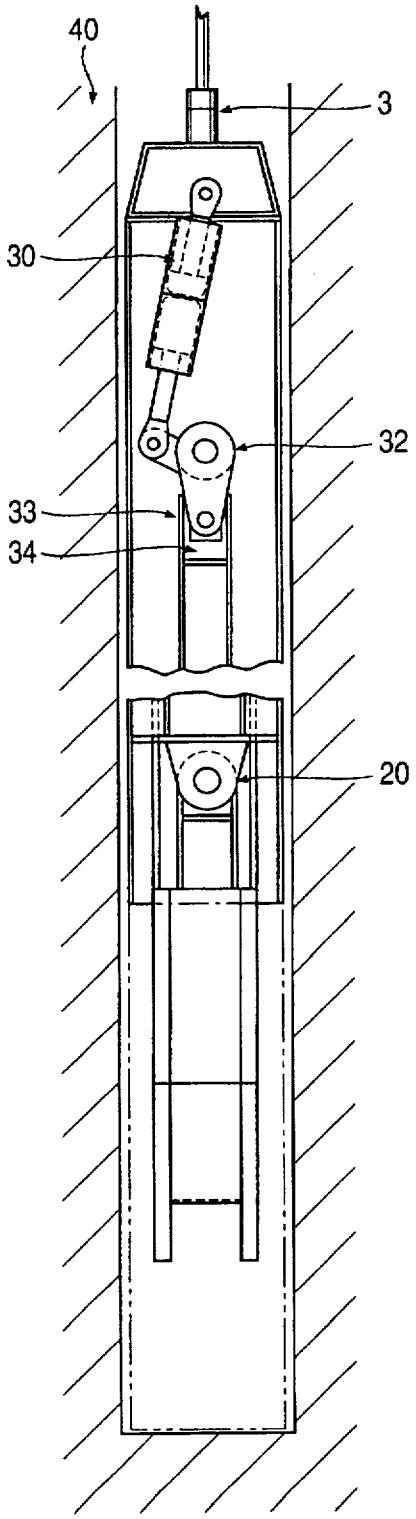
FIG. 2 represents a side view of the diaphragm wall grab according to FIG. 1 from a viewing direction along the diaphragm wall, with the guide body and inner body non-swivelled.
Figure 3:
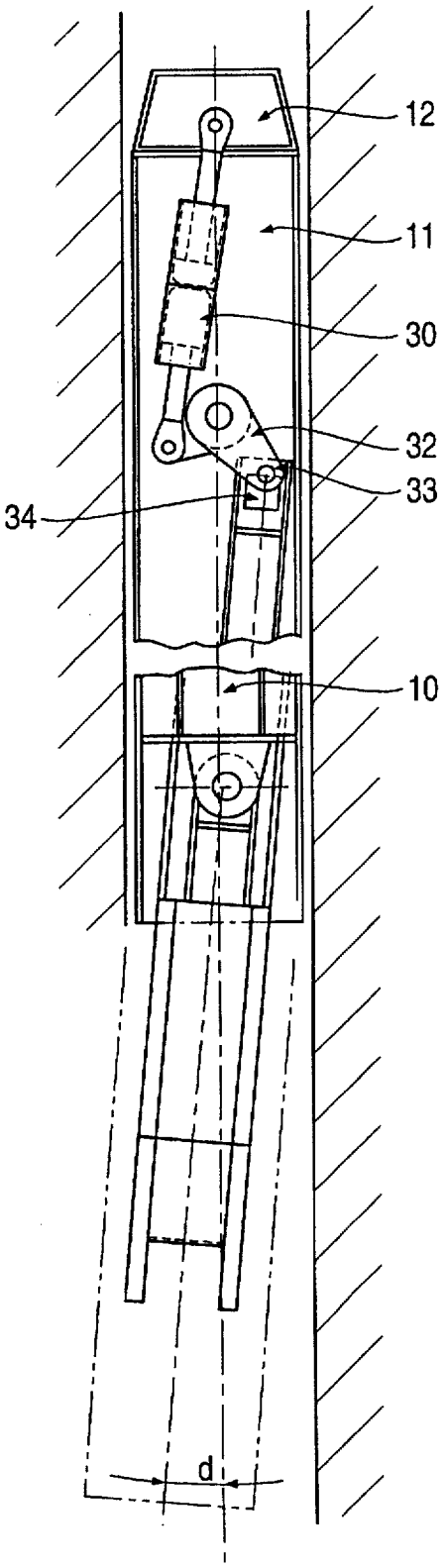
FIGS. 3 and 4 are side views according to FIG. 2, however, with the inner body swivelled relative to the guide body by an adjustment angle α.
Figure 4:
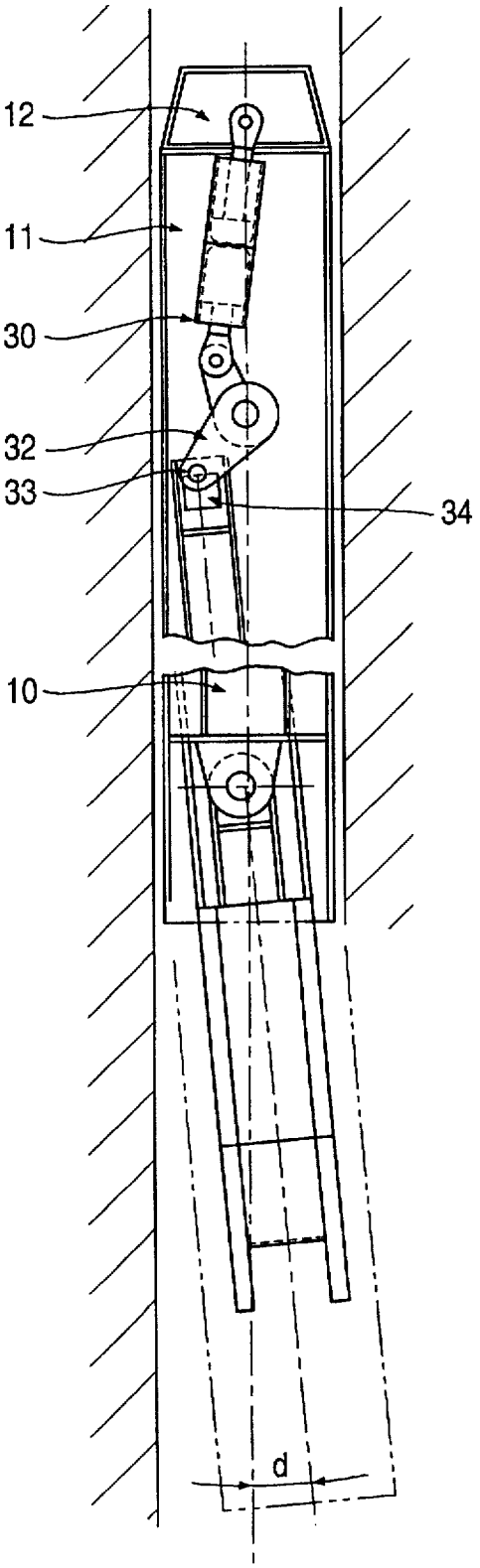
Figure 5:
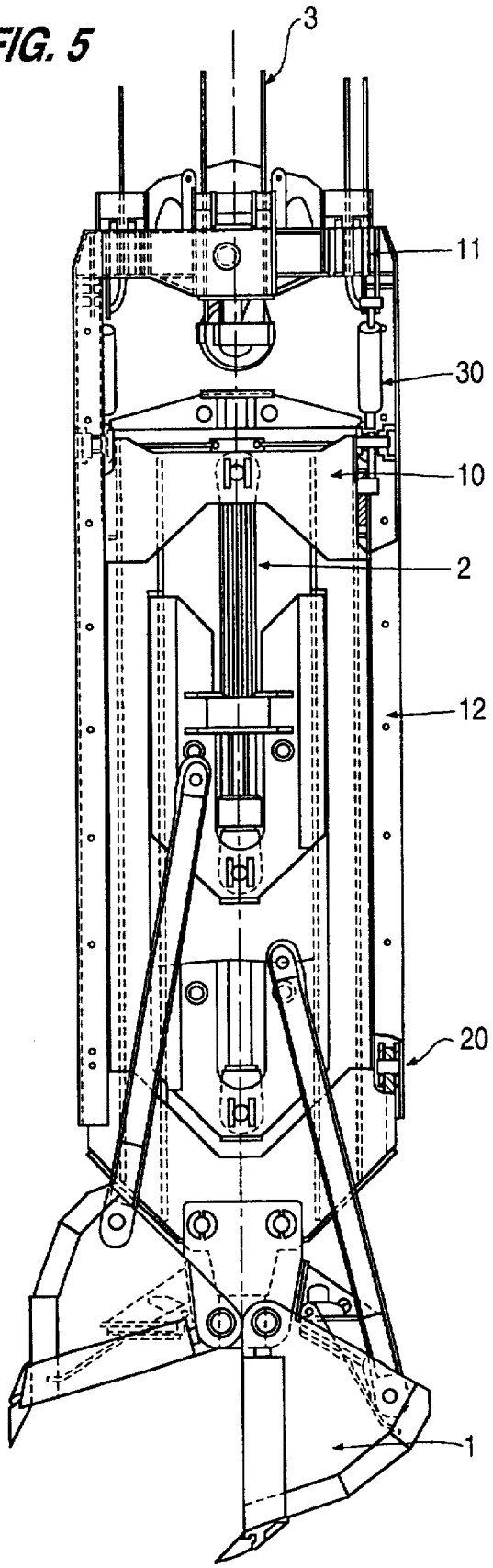
FIG. 5 shows a slightly different embodiment of the diaphragm wall grab in a projection transverse to the course of the diaphragm wall.
Figure 6:
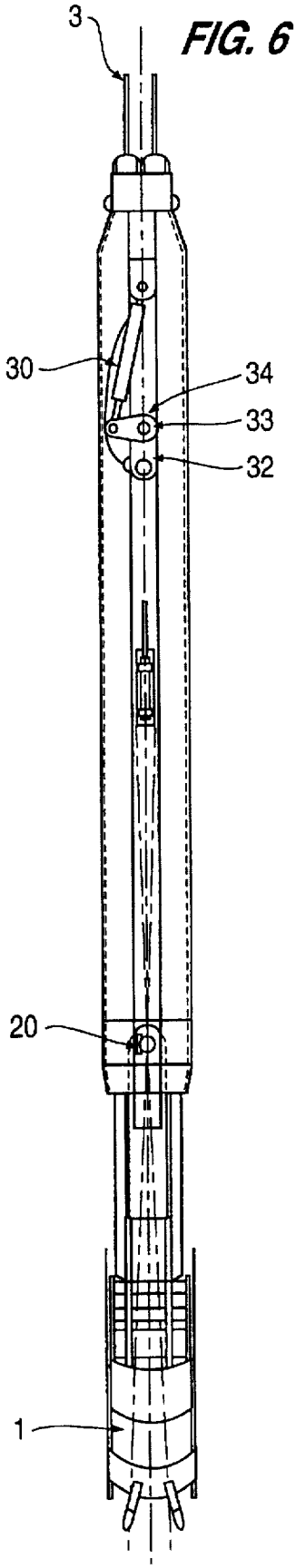
FIG. 6 shows the diaphragm wall grab according to FIG. 5 in side view from a viewing direction along the diaphragm wall.

As means for mutually swivelling the guide body 11 and the inner body 10 a piston/cylinder-unit 30 is hinged to the left and to the right side of the frame 12 of the guide body, it interacts with an articulated lever arrangement 32 which is also pivoted at the frame 12 and has a cam 33 which can be set in reciprocating swivelling movements. The cam engages into a U-shaped guidance 34 of the inner body 10 and swivels it, in accordance with the position of the cam 33, relative to the guide body 11 from the orthogonal position shown in FIGS. 2 and 6 into a different swivelling position corresponding to the adjustment angle α shown in FIGS. 3 and 4. As can be taken from FIGS. 1, 2, 5, and 6 the guide body 11 of the diaphragm wall grab is suspended in a rope 3. A comparison of the diaphragm wall grabs according to FIGS. 1 and 5 shows slight differences. The grab according to FIG. 5 is a comparatively heavier construction having a reinforced frame 12 of the outer guide body 11. In it the inner body 10 is hinged in the journals 20 in transverse direction to that of the slot. In contrast to the suspended arrangement according to FIGS. 1–4 the hydraulic cylinders 30 are arranged in a standing position. This is a purely mechanical measure within the discretion of the technical designer. As for the rest, the embodiments according to FIG. 1 and FIG. 5 have the same functions. According to the illustration of FIG. 1, the inner body 10 of the grab is preferably provided with an angle measuring device 25, and the indication of the deviation can be combined with a depth measuring device so that the deviation can be allocated to the corresponding slot depth and indicated in the control panel. The adjustment via the lever system 32 is absolutely uncomplicated, scarcely in need of maintenance and operates at high accuracy. The adjustment members 30 may consist of a cylinder body having a central cylinder bottom out of which two piston rods can be extended independently of each other, one of them being hinged to the outer body 11 of the grab and the other one to the inner body 10 of the grab. As can be seen in FIGS. 3 and 4, a horizontal swing in one direction can be effected up to angle α if both piston rods are extended (FIG. 3), and in case both piston rods are retracted a swing in the opposite direction up to angle α can be carried out. In this connection, the hydraulic control of the adjustment cylinders can be designed such that both a continuous adjustment in both directions and a defined central or neutral position may be selected by the operator at will.

Owing to the articulated arrangement the hydraulic diaphragm wall grab according to the present invention is an extremely uncomplicated and sturdily built device and makes it possible to adjust the advance direction of the grab shovels either fully automatic or manually. In this respect, the present invention perfectly fulfils the object stated in the beginning of this specification.

I claim:

1. A process for maintaining a vertical excavating direction of a diaphragm wall during excavation with a hydraulic diaphragm wall grabber cooperating with an excavator and having an outer guide body, an inner body mounted in the outer guide body and a grabber appliance mounted to the inner body, said process comprising:

detecting, with an inclination detector, an inclination of at least one of the inner body and the outer guide body relative to a vertical direction;

controlling, with a control unit operatively connected to the inclination detector and at least one of the inner body and the outer guide body, an orientation of at least one of the inner body and the outer guide body so as to compensate for deviation of the at least one of the inner body and the outer guide body to which the control unit is operatively connected by swiveling the inner body relative to the outer guide body in a direction opposite to a direction of the deviation.

2. A process as recited in claim 1, further comprising manually overriding, from a control panel of the excavator, the orientation compensation control of the control unit.

3. A process as recited in claim 1, further comprising detecting, with a depth detection unit operatively connected to the diaphragm wall grabber and to the control unit, a depth of the diaphragm wall.

4. A device for maintaining a vertical excavating direction of a diaphragm wall, said device comprising:

an outer guide body;

an inner body mounted in said outer guide body;

at least one grab shovel hingedly mounted to said inner body;

at least one horizontal journal connecting said inner body to said outer guide body;

a hydraulic swivel mechanism operatively connected between said inner body and said outer guide body;

an inclination detector operatively connected to at least one of said inner body and said outer guide body for detecting an orientation of said at least one of said inner body and said outer guide body relative to a vertical direction; and a control unit, operatively connected to said inclination detector and said at least one of said inner body and said outer guide body, for operating said hydraulic swivel mechanism to control an orientation of said at least one of said inner body and said outer guide body so as to compensate for deviation of said at least one of said inner body and said outer guide body to swivel the inner body relative to the outer guide body in a direction opposite to a direction of the deviation.

5. A device as recited in claim 4, further comprising means formanually overriding, from a control panel of the excavator, the orientation compensation control of the control unit.

6. A device as recited in claim 5, wherein a U-shaped guide is mounted on said inner body; and said hydraulic swivel mechanism comprises a hydraulic piston-and-cylinder unit hinged to said outer guide body, an articulated lever arrangement pivotally mounted to said outer guide body and operatively connected to said hydraulic piston-and-cylinder unit, and a cam mounted to said articulated lever arrangement and disposed in said U-shaped guide.

7. A device as recited in claim 4, further comprising a depth measuring unit, operatively connected to the diaphragm wall grabber and to the control unit, for measuring a depth of the diaphragm wall.

8. A device as recited in claim 7, wherein a U-shaped guide is mounted on said inner body; and said hydraulic swivel mechanism comprises a hydraulic piston-and-cylinder unit hinged to said outer guide body, an articulated lever arrangement pivotally mounted to said outer guide body and operatively connected to said hydraulic piston-and-cylinder-unit, and a cam mounted to said articulated lever arrangement and disposed in said U-shaped guide.

9. A device as recited in claim 4, wherein a U-shaped guide is mounted on said inner body; and said hydraulic swivel mechanism comprises a hydraulic piston-and-cylinder unit hinged to said outer guide body, an articulated lever arrangement pivotally mounted to said outer guide body and operatively connected to said hydraulic piston-and-cylinder unit, and a cam mounted to said articulated lever arrangement and disposed in said U-shaped guide.

* * * * *